US009945568B2

(12) United States Patent
Yokoyama et al.

(10) Patent No.: US 9,945,568 B2
(45) Date of Patent: Apr. 17, 2018

(54) AIR CONDITIONING APPARATUS

(71) Applicant: DAIKIN INDUSTRIES, LTD., Osaka-shi, Osaka (JP)

(72) Inventors: Naofumi Yokoyama, Sakai (JP); Tsuyoshi Yokomizo, Sakai (JP); Takahiro Yamasaki, Sakai (JP); Takashi Kashihara, Sakai (JP); Akihiko Mori, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 381 days.

(21) Appl. No.: 14/687,273

(22) Filed: Apr. 15, 2015

(65) Prior Publication Data

US 2015/0300360 A1 Oct. 22, 2015

(30) Foreign Application Priority Data

Apr. 18, 2014 (JP) ..... 2014-086209

(51) Int. Cl.

| | |
|---|---|
| ***F24F 7/06*** | (2006.01) |
| ***F24F 7/007*** | (2006.01) |
| ***F24F 1/00*** | (2011.01) |
| ***F04D 29/02*** | (2006.01) |
| ***F04D 29/28*** | (2006.01) |
| ***F04D 29/58*** | (2006.01) |

(52) U.S. Cl.

CPC ..... *F24F 1/0022* (2013.01); *F04D 29/023* (2013.01); *F04D 29/281* (2013.01); *F04D 29/5853* (2013.01); *F05D 2300/44* (2013.01)

(58) Field of Classification Search

CPC ..... F24F 1/0007; F24F 1/0022; F24F 1/0018; F24F 1/0059; F24F 2001/004; F24F 2003/106; F24F 2003/1064; F24F 2203/106; F24F 2203/1064

See application file for complete search history.

(56) References Cited

U.S. PATENT DOCUMENTS 2,382,502 A * 8/1945 Philipp ..... F24F 1/0007 165/125
2004/0253098 A1* 12/2004 Hancock ..... F04D 17/02 415/206

(Continued)

FOREIGN PATENT DOCUMENTS

JP 6-281194 A 10/1994
JP 2009-198141 A 9/2009

*Primary Examiner* — Steven B McAllister
*Assistant Examiner* — Jonathan Cotov
(74) *Attorney, Agent, or Firm* — Global IP Counselors, LLP

(57) ABSTRACT

An air conditioning apparatus includes a casing having intake and blow-out ports, a partition member dividing an interior of the casing, a heat exchanger, a centrifugal fan, a heater and a fan heat shield. The centrifugal fan includes a bladed wheel mounted in the fan compartment such that a rotary shaft of the bladed wheel is oriented along an opening direction of the fan entrance and an opening direction of the blow-out port, and the bladed wheel being made of resin. The heater is mounted in a blow-out port opposed space opposed to the blow-out port within a fan downwind space located on a downwind side of the bladed wheel within the fan compartment. The fan heat shield member is mounted in the fan downwind space in order to cover a part of the bladed wheel that is opposed to the heater.

11 Claims, 14 Drawing Sheets

(56) References Cited

U.S. PATENT DOCUMENTS

| | | | | |
|---|---|---|---|---|
| 2005/0086973 | A1* | 4/2005 | Han | F04D 29/4213 62/419 |
| 2005/0109054 | A1* | 5/2005 | Eom | F24F 1/0007 62/286 |
| 2006/0037355 | A1* | 2/2006 | Hwang | F24F 1/0007 62/428 |
| 2008/0070493 | A1* | 3/2008 | Rimmer | F24F 1/0007 454/186 |
| 2010/0115983 | A1* | 5/2010 | Ikeda | F04D 29/281 62/426 |
| 2012/0276836 | A1* | 11/2012 | Stewart | F24F 13/20 454/251 |
| 2015/0219348 | A1* | 8/2015 | Ikeda | F24F 1/0018 454/249 |
| 2015/0300668 | A1* | 10/2015 | Yamasaki | F24H 9/0073 454/249 |
| 2015/0300669 | A1* | 10/2015 | Kashihara | F24F 1/0022 454/249 |
| 2015/0300688 | A1* | 10/2015 | Yokoyama | F24H 9/0073 392/360 |

* cited by examiner

AIR CONDITIONING APPARATUS

CROSS-REFERENCE TO RELATED APPLICATIONS

This application claims priority under 35 U.S.C. § 119 to Japanese Patent Application No. 2014-086209, filed Apr. 18, 2014. The entire disclosure of Japanese Patent Application No. 2014-086209 is hereby incorporated herein by reference.

FIELD OF THE INVENTION

The present invention relates to an air conditioning apparatus, particularly to an air conditioning apparatus that a rearward bladed centrifugal fan is mounted in a fan compartment having a fan entrance bored in opposition to a blow-out port such that a rotary shaft of the centrifugal fan is oriented to an opening direction of the fan entrance and an opening direction of the blow-out port.

BACKGROUND INFORMATION

As described in Japan Laid-open Patent Application Publication No. H06-281194, an air conditioning apparatus has been produced so far that a rearward bladed centrifugal fan is mounted in a ventilation unit (a fan compartment) having a fan entrance bored in opposition to a blow-out port such that a rotary shaft of the centrifugal fan is oriented to an opening direction of the fan entrance and an opening direction of the blow-out port. On the other hand, as described in Japan Laid-open Patent Application Publication No. 2009-198141, an air conditioning apparatus equipped with a sirocco fan (a multi-bladed fan) has been produced in which a temperature regulation element (heating means) is mounted in the vicinity of a blow-out port of the sirocco fan.

SUMMARY

It can be herein assumed to mount such heating means as described in Japan Laid-open Patent Application Publication No. 2009-198141 in the vicinity of a blow-out port in such an air conditioning apparatus equipped with a centrifugal fan as described in Japan Laid-open Patent Application Publication No. H06-281194.

However, when an event occurs that an operation of the centrifugal fan stops due to a trouble of a fan motor or so firth while an operation of the heating means continues, a bladed wheel of the centrifugal fan is inevitably heated by radiant heat from the heating means. At this time, when a bladed wheel made of resin is employed as the bladed wheel for the centrifugal fan, chances are that the resin bladed wheel is damaged or broken by the radiant heat from the heating means.

Therefore, it is difficult to employ such a resin bladed wheel as a bladed wheel for a rearward bladed centrifugal fan when heating means is mounted in the vicinity of a blow-out port in an air conditioning apparatus that the rearward bladed centrifugal fan is mounted in a fan compartment having a fan entrance bored in opposition to the blow-out port such that a rotary shaft of the centrifugal fan is oriented to an opening direction of the fan entrance and an opening direction of the blow-out port.

It is an object of the present invention to enable a bladed wheel made of resin to be employed as a bladed wheel of a rearward bladed centrifugal fan when heating means is mounted in the vicinity of a blow-out port in an air conditioning apparatus that the rearward bladed centrifugal fan is mounted in a fan compartment having a fan entrance bored in opposition to the blow-out port such that a rotary shaft of the centrifugal fan is oriented to an opening direction of the fan entrance and an opening direction of the blow-out port.

An air conditioning apparatus according to a first aspect includes a casing, a partition member, a heat exchanger and a centrifugal fan. The casing has an intake port and a blow-out port. The partition member divides an interior of the casing into a heat exchanger compartment located on an intake port side and a fan compartment located on a blow-out port side, and has a fan entrance that is bored in opposition to the blow-out port and makes the heat exchanger compartment and the fan compartment communicate with each other. The heat exchanger is mounted in the heat exchanger compartment. The centrifugal fan includes a bladed wheel having a plurality of rearward blades and is configured to suck air existing in the heat exchanger compartment into the fan compartment through the fan entrance, with the bladed wheel being mounted in the fan compartment such that a rotary shaft of the bladed wheel is oriented to an opening direction of the fan entrance and an opening direction of the blow-out port. Moreover, the air conditioning apparatus includes heating means. The heating means is mounted in a blow-out port opposed space, which is a region opposed to the blow-out port within a fan downwind space that is a space located on a downwind side of the bladed wheel within the fan compartment. The bladed wheel is herein made of resin, and the air conditioning apparatus includes a fan heat shield member. The fan heat shield member is mounted in the fan downwind space for covering a part of the bladed wheel that is opposed to the heating means.

As described above, the heating means is herein designed to be mounted in the blow-out port opposed space, and the fan heat shield member is designed to be mounted in the fan downwind space so as to cover a part of the resin-made bladed wheel that is opposed to the heating means. With the construction, even when an event herein occurs that an operation of the centrifugal fan stops while an operation of the heating means continues, it is possible to prevent damage or breakage of the resin-made bladed wheel by radiant heat from the heating means.

Consequently, when the heating means is herein mounted in the vicinity of the blow-out port, a bladed wheel made of resin can be employed as the bladed wheel of the centrifugal fan.

An air conditioning apparatus according to a second aspect relates to the air conditioning apparatus according to the first aspect, and wherein the fan heat shield member has a size of less than or equal to an outer diameter of the bladed wheel when seen from a direction along the rotary shaft.

As described above, when the fan heat shield member is herein disposed in the fan downwind space, the fan heat shield member is set to have a size of less than or equal to the outer diameter of the bladed wheel in a view seen from the direction along the rotary shaft. With the construction, the fan heat shield member can be herein disposed in the fan downwind space without increasing ventilation resistance as much as possible.

Consequently, degradation in ventilation performance of the centrifugal fan can be herein inhibited as much as possible, and simultaneously, the fan heat shield member can be disposed in the fan downwind space.

An air conditioning apparatus according to a third aspect relates to the air conditioning apparatus according to the first or second aspect, and wherein the bladed wheel has a hub that connects blow-out port side ends of the plural rearward blades and is configured to be rotated about the rotary shaft. Furthermore, the fan heat shield member at least partially covers a part of the hub that is opposed to the heating member.

As described above, the fan heat shield member is herein designed to at least partially cover a part of the hub of the bladed wheel, i.e., a part opposed to the heating means. With the construction, it is herein possible to prevent damage or breakage of the hub composing the bladed wheel of the centrifugal fan.

Consequently, it is herein possible to prevent damage or breakage of the hub disposed closest to the heating means among the constituent elements of the bladed wheel of the centrifugal fan.

An air conditioning apparatus according to a fourth aspect relates to the air conditioning apparatus according to the third aspect, and wherein the fan heat shield member is disposed away from the hub through a gap.

As described above, the fan heat shield member is herein designed to be disposed away from the hub through the gap. With the construction, it can be herein made difficult to transfer radiant heat from the heating means to the hub through the fan heat shield member.

Consequently, it is herein possible to reliably prevent damage or breakage of the hub disposed closest to the heating means among the constituent elements of the bladed wheel of the centrifugal fan.

An air conditioning apparatus according to a fifth aspect relates to the air conditioning apparatus according to the fourth aspect, and wherein the gap between the fan heat shield member and the hub is set to have a dimension of 80 mm or less.

As described above, when the fan heat shield member is herein disposed in the fan downwind space, the gap between the fan heat shield member and the hub is set to have a dimension of 80 mm or less. With the construction, the fan heat shield member can be herein disposed in the fan downwind space without increasing ventilation resistance as much as possible.

Consequently, degradation in ventilation performance of the centrifugal fan can be herein inhibited as much as possible, and simultaneously, the fan heat shield member can be disposed in the fan downwind space.

An air conditioning apparatus according to a sixth aspect relates to the air conditioning apparatus according to any one of the third to fifth aspects, and further includes a fan motor that is coupled to the hub and is mounted in the fan downwind space. The fan heat shield member is disposed between the hub and the fan motor. Furthermore, the fan heat shield member is at least partially cut out at a part thereof overlapping with the fan motor when seen from the direction along the rotary shaft.

As described above, when the fan heat shield member and the fan motor are herein disposed in the fan downwind space, the fan heat shield member is designed to be disposed between the fan motor and the hub of the bladed wheel, and is designed to be at least partially cut out at a part thereof overlapping with the fan motor when seen from the direction along the rotary shaft. With the construction, the part of the fan heat shield member, covering the hub of the bladed wheel, can be herein reduced.

Consequently, the fan heat shield member can be herein reduced in size, and simultaneously, it is possible to prevent damage or breakage of the hub of the bladed wheel by radiant heat from the heating means.

An air conditioning apparatus according to a seventh aspect relates to the air conditioning apparatus according to the sixth aspect, and further includes a motor heat shield member for covering a part of the fan motor that is opposed to the heating means.

As described above, when the fan motor is herein disposed in the fan downwind space, the motor heat shield member is designed to be further provided. With the construction, it is possible to prevent heating of the fan motor by radiant heat from the heating means.

Consequently, it is herein possible to prevent abnormal overheating of the fan motor by radiant heat from the heating means.

An air conditioning apparatus according to an eighth aspect relates to the air conditioning apparatus according to the seventh aspect, and wherein the motor heat shield member has a motor guide port for directing a part of air blown out to the fan downwind space by the bladed wheel to the blow-out port opposed space through the fan motor from a blow-out port non-opposed space that is a region not opposed to the blow-out port within the fan downwind space.

When the motor heat shield member is herein disposed in the fan downwind space, the motor guide port is designed to be formed. With the construction, it is herein possible to reliably cause air to flow in the vicinity of the fan motor.

Consequently, the fan motor can be herein cooled by air blown out by the bladed wheel of the centrifugal fan, and simultaneously, the motor heat shield member can be disposed in the fan downwind space.

BRIEF DESCRIPTION OF THE DRAWINGS

Referring now to the attached drawings which form a part of this original disclosure.

DETAILED DESCRIPTION OF EMBODIMENTS

An air conditioning apparatus according to a preferred embodiment of the present invention will be hereinafter explained on the basis of the attached drawings. It should be noted that a specific construction of the air conditioning apparatus according to the present invention is not limited to the following preferred embodiment and the modifications thereof, and can be changed without departing from the scope of the present invention.

(1) Basic Construction of Air Conditioning Apparatus

Figure 1:
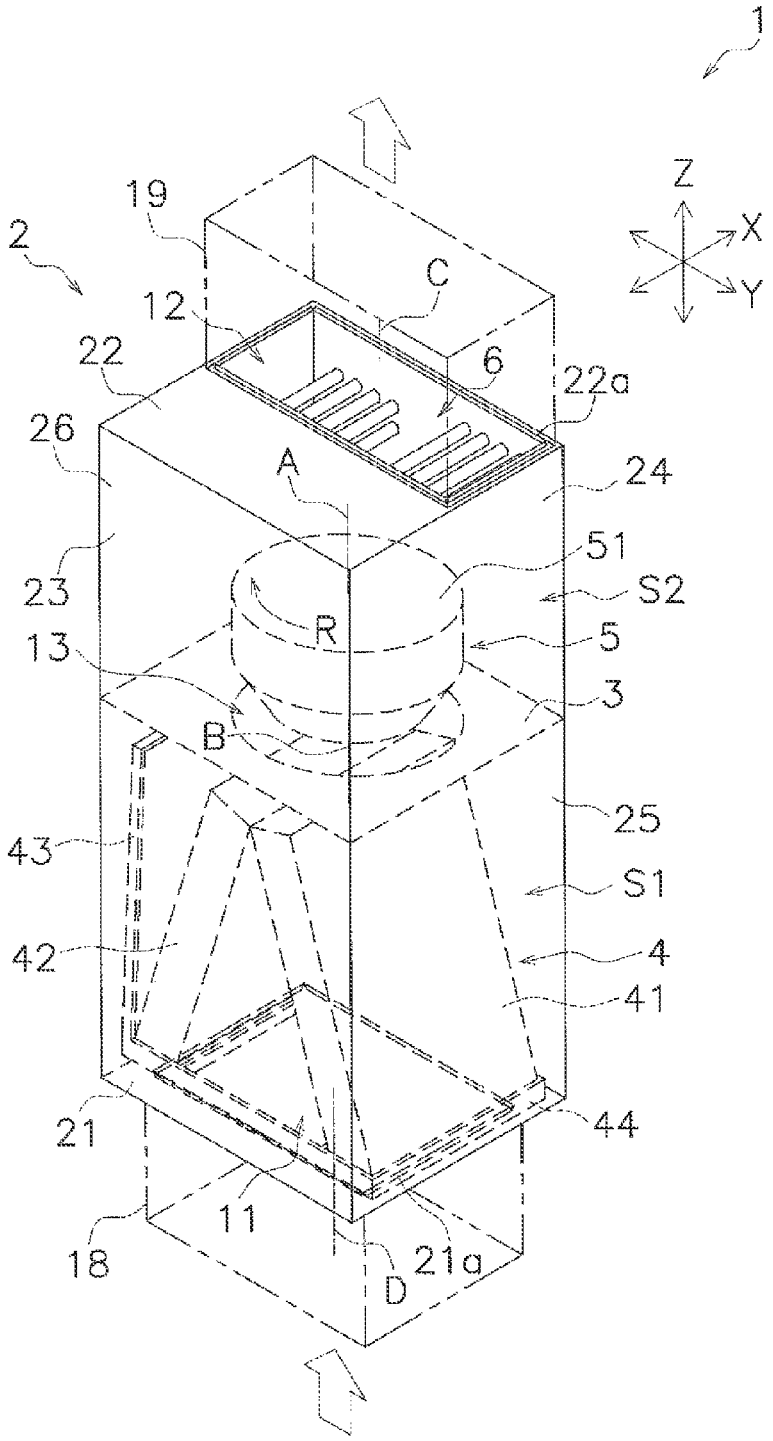
FIG. 1 is an external perspective view of an air conditioning apparatus according to a preferred embodiment of the present invention (in a vertical mount configuration)
Figure 2:
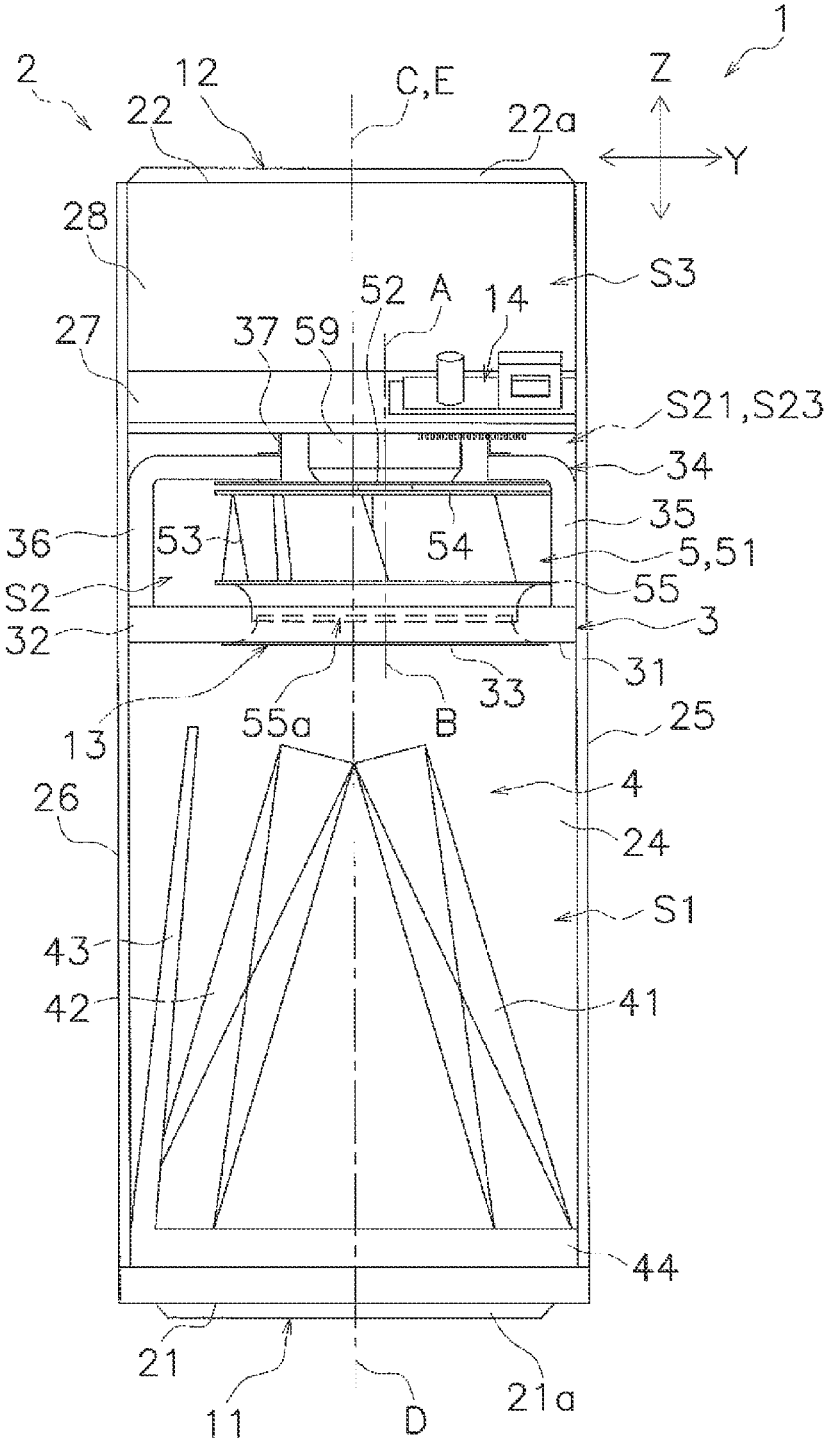
FIG. 2 is a front lateral view of the air conditioning apparatus from which a first lateral part is detached (in the vertical mount configuration)
Figure 3:
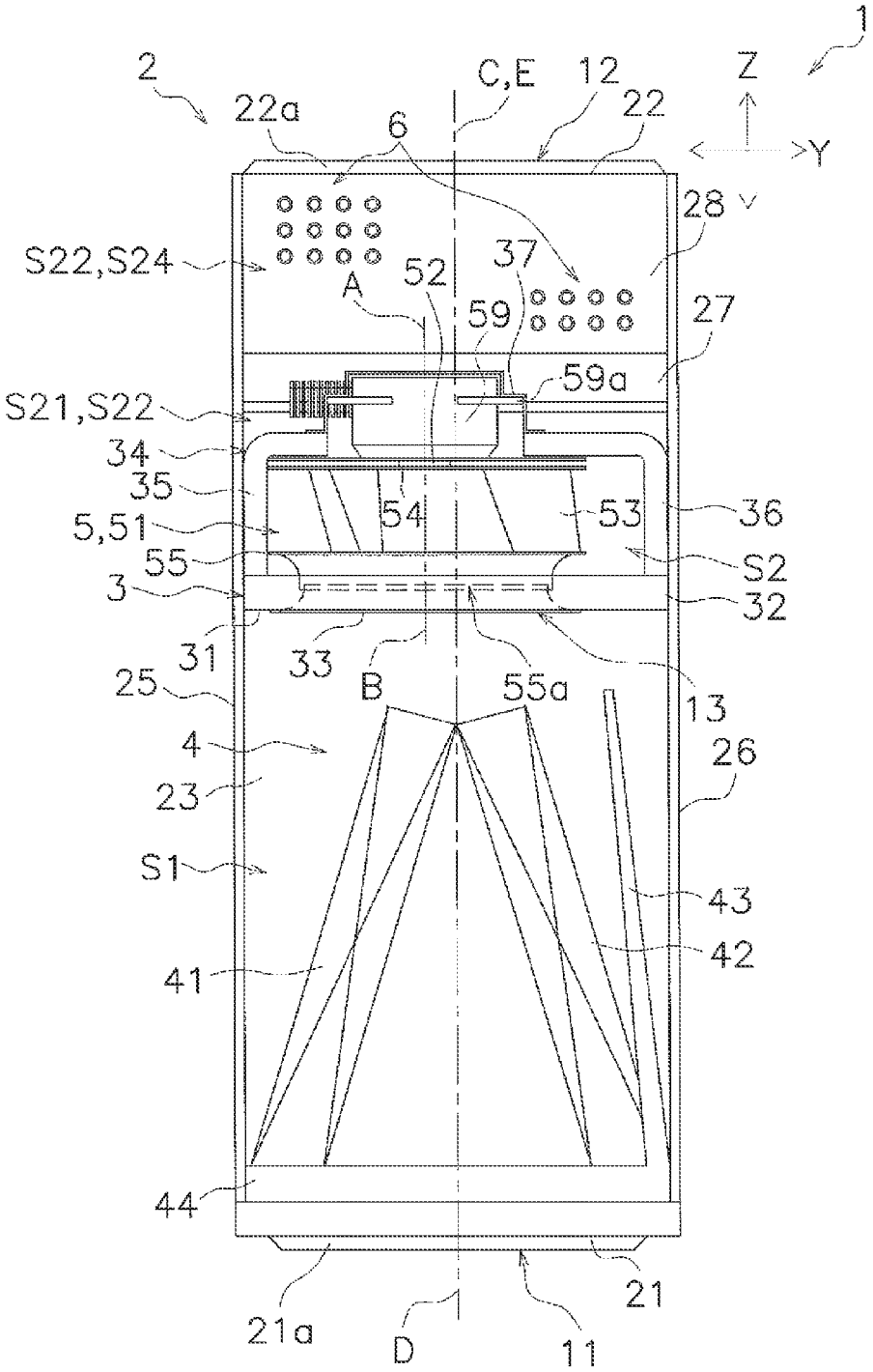
FIG. 3 is a rear lateral view of the air conditioning apparatus from which a second lateral part is detached (in the vertical mount configuration)
Figure 4:
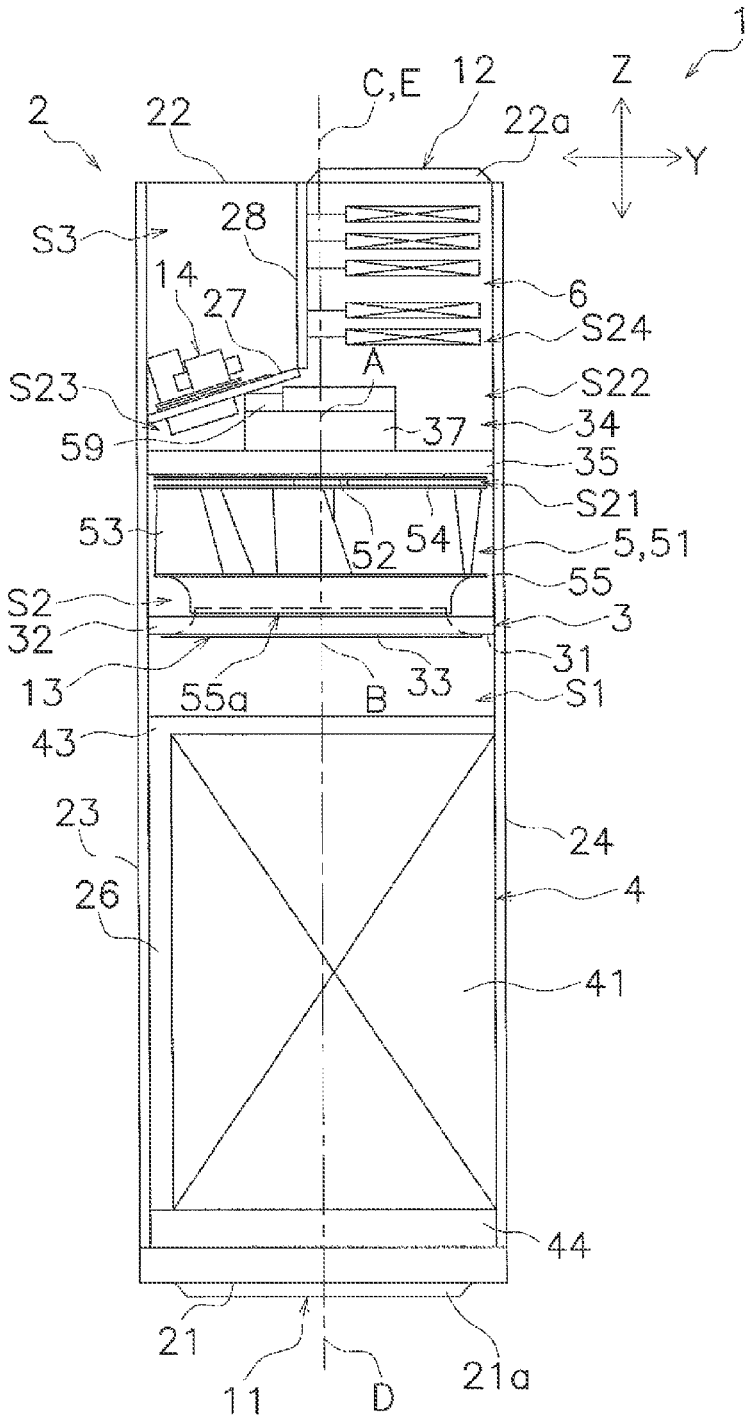
FIG. 4 is a right lateral view of the air conditioning apparatus from which a third lateral part is detached (in the vertical mount configuration)
Figure 5:
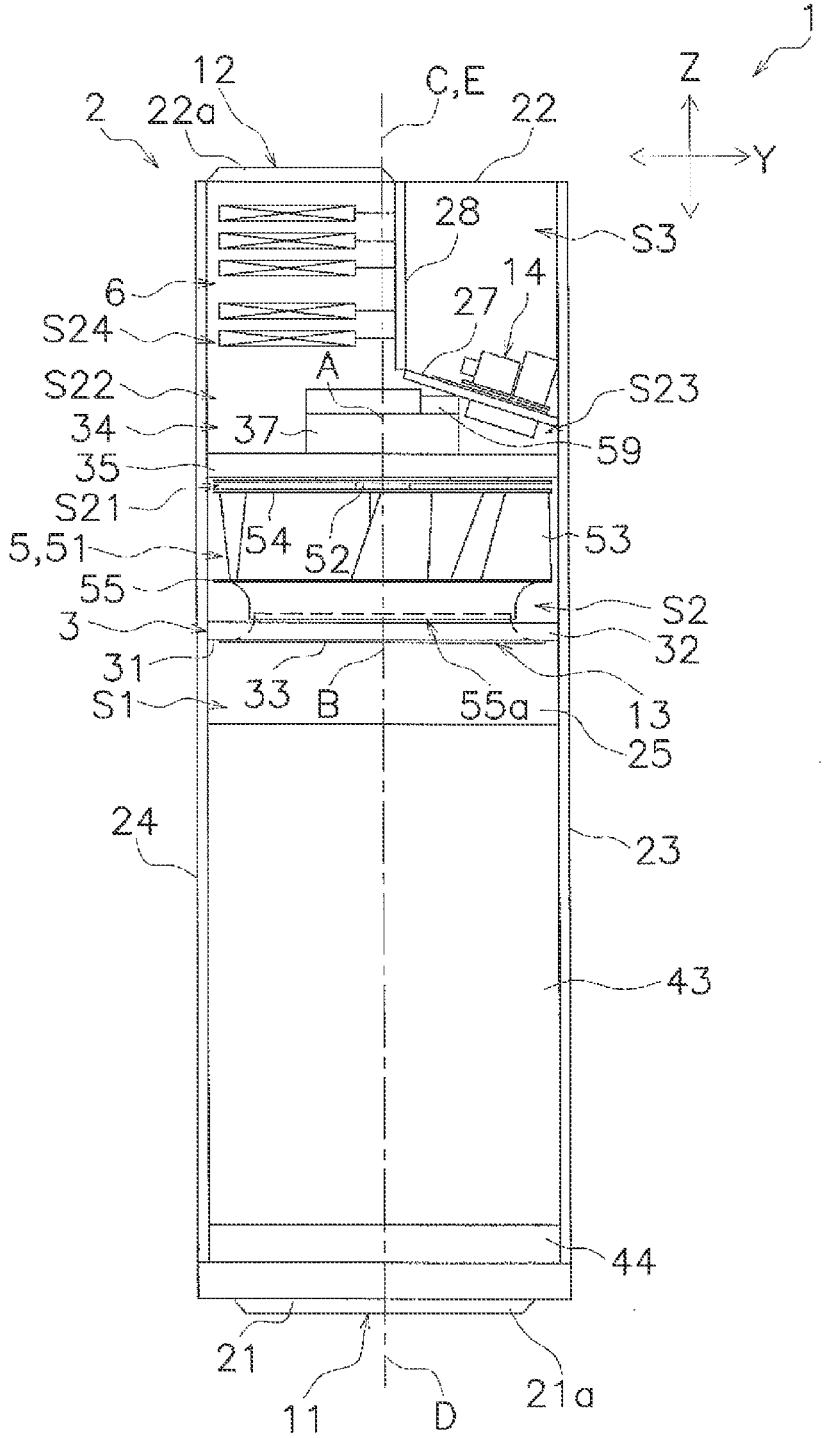
FIG. 5 is a left lateral view of the air conditioning apparatus from which a fourth lateral part is detached (in the vertical mount configuration)
Figure 6:
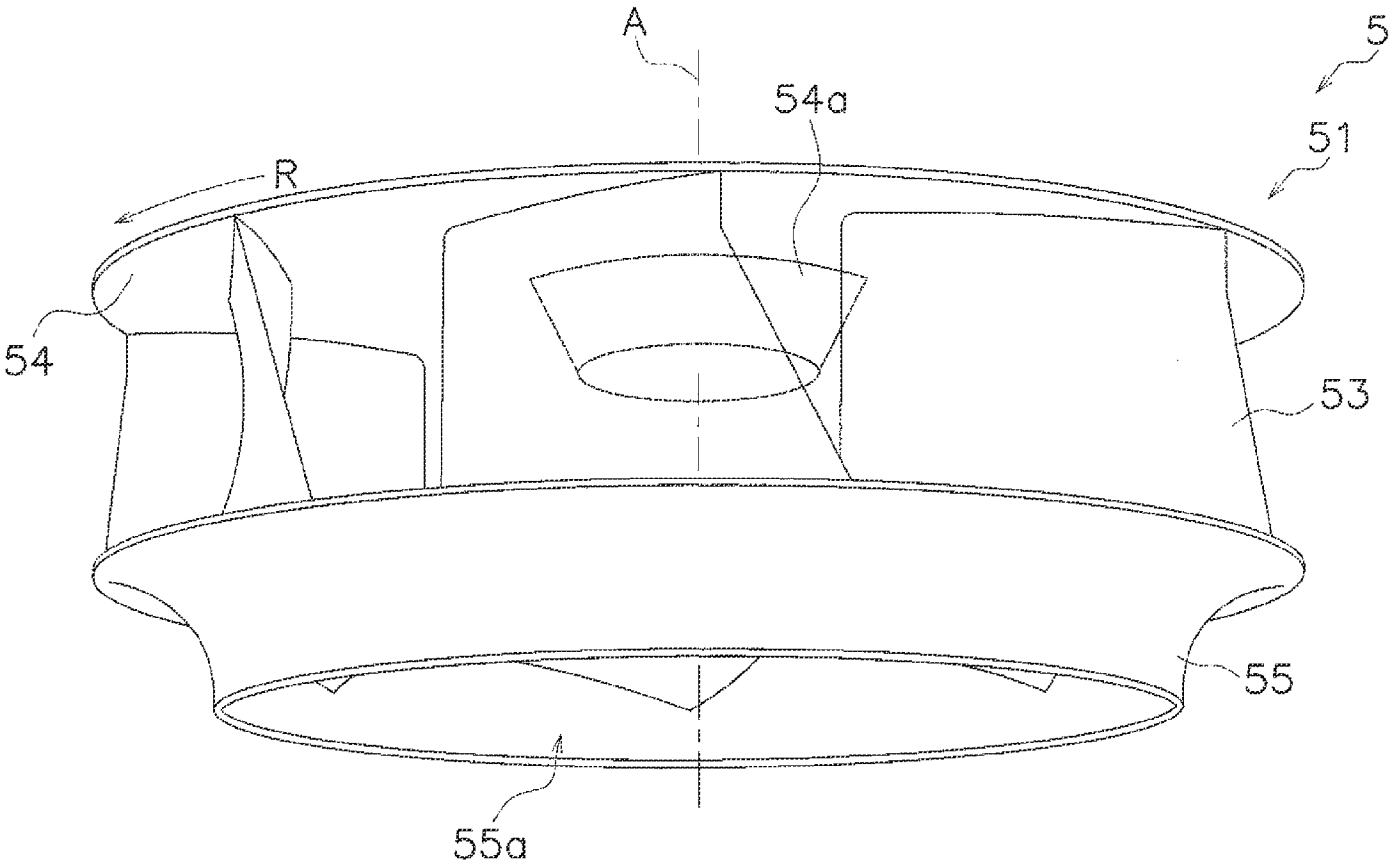
FIG. 6 is an external perspective view of a bladed wheel of a centrifugal fan.
Figure 7:
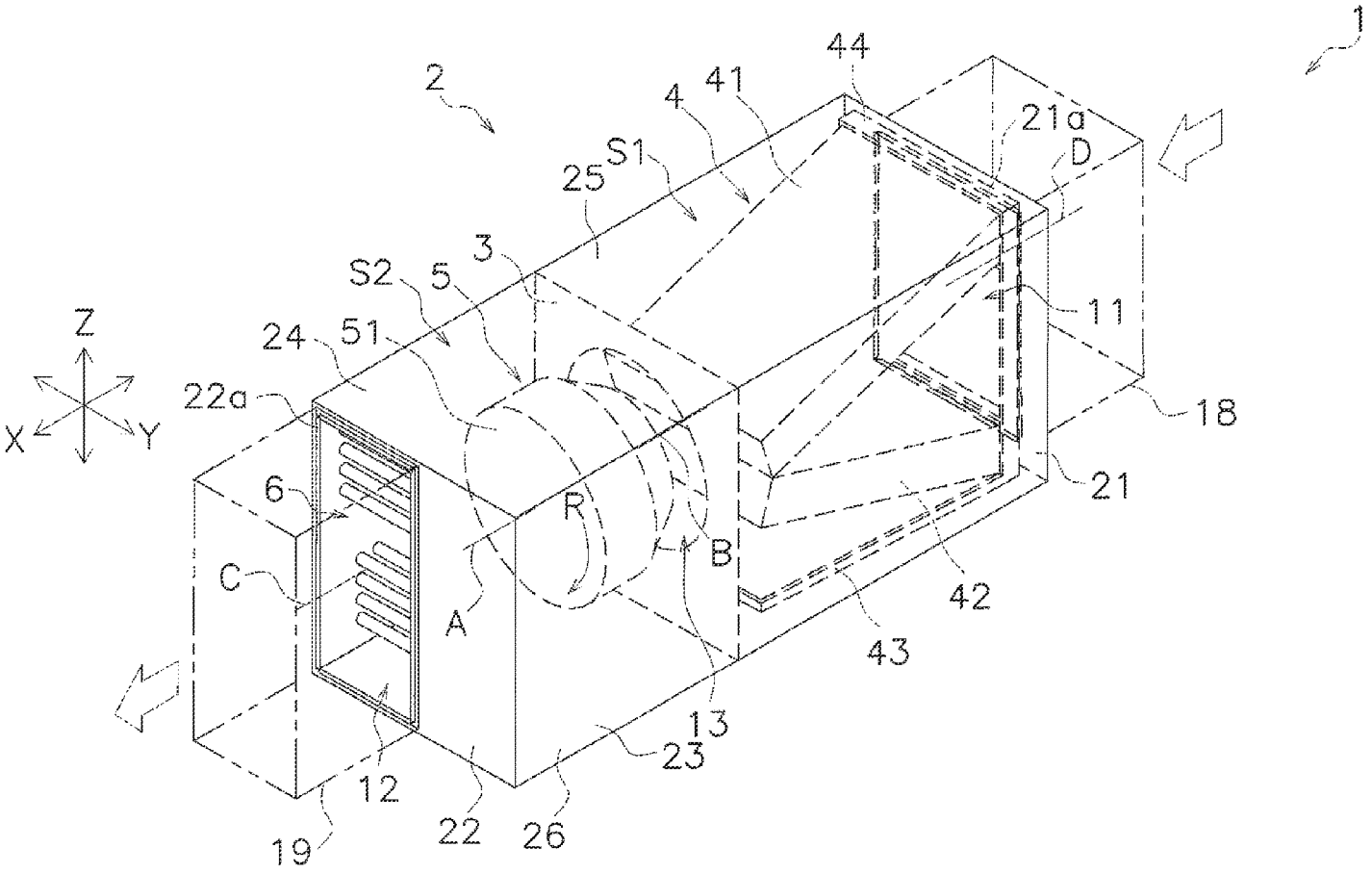
FIG. 7 is an external perspective view of the air conditioning apparatus (in a horizontal mount configuration)
Figure 8:
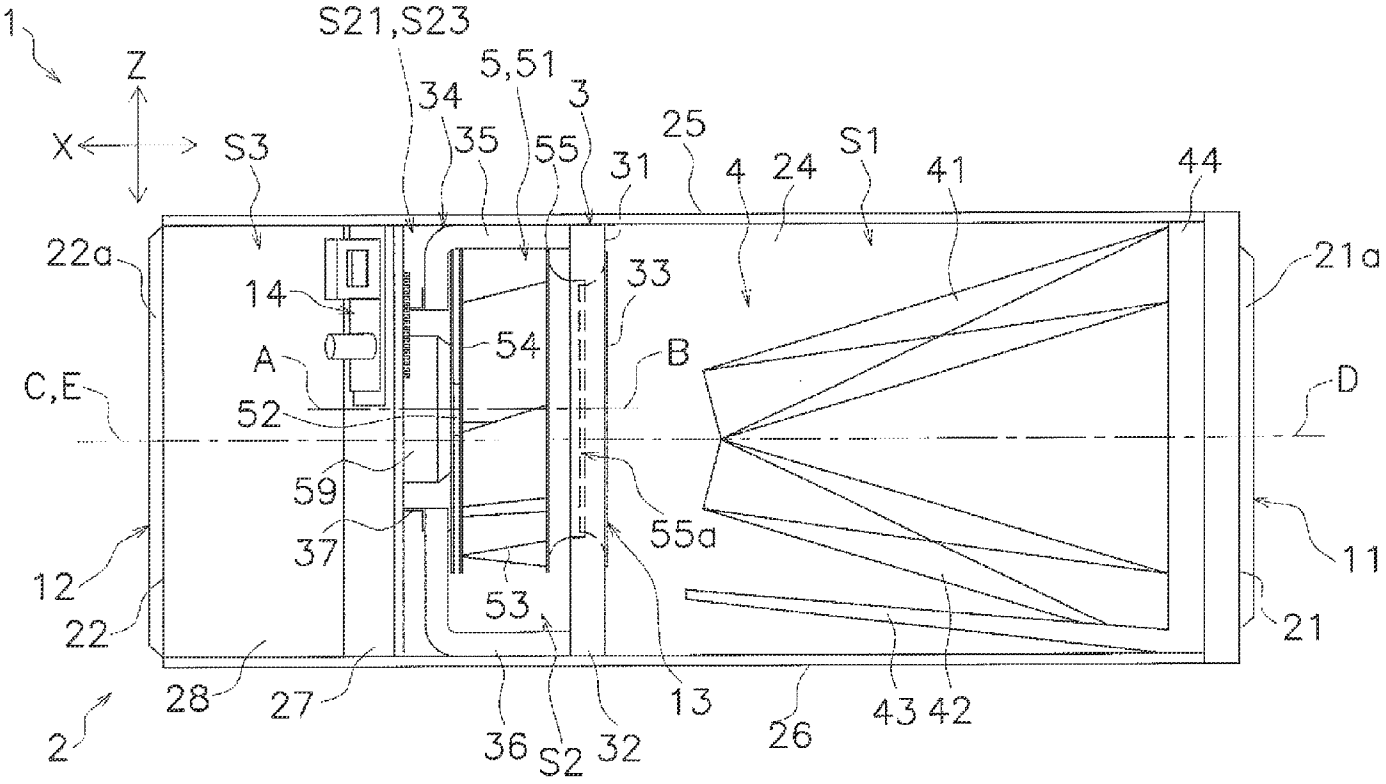
FIG. 8 is a right lateral view of the air conditioning apparatus from which the first lateral part is detached (in the horizontal mount configuration)

First, a basic construction of an air conditioning apparatus 1 will be explained with FIGS. 1 to 8. Here, FIG. 1 is an external perspective view of the air conditioning apparatus 1 according to the preferred embodiment of the present invention (in a vertical mount configuration). FIG. 2 is a front lateral view of the air conditioning apparatus 1 from which a first lateral part 23 is detached (in the vertical mount configuration). FIG. 3 is a rear lateral view of the air conditioning apparatus 1 from which a second lateral part 24 is detached (in the vertical mount configuration). FIG. 4 is a right lateral view of the air conditioning apparatus 1 from which a third lateral part 25 is detached (in the vertical mount configuration). FIG. 5 is a left lateral view of the air conditioning apparatus 1 from which a fourth lateral part 26 is detached (in the vertical mount configuration). FIG. 6 is an external perspective view of a bladed wheel of a centrifugal fan. FIG. 7 is an external perspective view of the air conditioning apparatus 1 (in a horizontal mount configuration). FIG. 8 is a right lateral view of the air conditioning apparatus 1 from which the first lateral part 23 is detached (in the horizontal mount configuration).

The air conditioning apparatus 1 is an apparatus installed in a building in order to perform a cooling operation and a heating operation for the indoor space of the building. The air conditioning apparatus 1 includes a casing 2, a partition member 3, a heat exchanger 4 and a centrifugal fan 5. The casing 2 has an intake port 11 and a blow-out port 12. The partition member 3 divides the interior of the casing 2 into a heat exchanger compartment S1 located on the intake port 11 side and a fan compartment S2 located on the blow-out port 12 side, and has a fan entrance 13 making the heat exchanger compartment S1 and the fan compartment S2 communicate with each other. The heat exchanger 4 is mounted in the heat exchanger compartment S1. The centrifugal fan 5 includes a bladed wheel 51 having a plurality of rearward blades 53 and is configured to suck air existing in the heat exchanger compartment S1 into the fan compartment S2 through the fan entrance 13, with the bladed wheel 51 being mounted in the fan compartment S2 such that a rotary shaft 52 (its axis will be referred to as a rotary axis A) is oriented to an opening direction B of the fan entrance 13.

Moreover, the fan entrance 13 is herein opposed to the blow-out port 12, and the rotary shaft 52 (the rotary axis A) of the bladed wheel 51 is oriented to the opening direction B of the fan entrance 13 and an opening direction C of the blow-out port 12. Furthermore, the intake port 11 is herein opposed to the fan entrance 13, and the rotary shaft 52 (the rotary axis A) of the bladed wheel 51 is oriented to the opening direction B of the fan entrance 13, the opening direction C of the blow-out port 12 and an opening direction D of the intake port 11.

Moreover, the air conditioning apparatus 1 is herein capable of taking two configurations, i.e., the vertical mount configuration and the horizontal mount configuration. In the vertical mount configuration, the casing 2 is disposed such that the rotary shaft 52 (the rotary axis A) of the bladed wheel 51 is oriented to a vertical direction Z (see FIGS. 1 to 5). In the horizontal mount configuration, the casing 2 is disposed such that the rotary shaft 52 (the rotary axis A) of the bladed wheel 51 is oriented to a horizontal direction X (see FIGS. 7 and 8).

As described above, the casing 2 has the intake port 11 and the blow-out port 12. The casing 2 is mainly composed of an upstream lateral part 21, a downstream lateral part 22, the first lateral part 23, the second lateral part 24, the third lateral part 25 and the fourth lateral part 26. These lateral parts 21 to 26 form the elongated cuboid casing 2. The upstream lateral part 21 is a member configured to form the bottom lateral surface of the casing 2 in the vertical mount configuration and form the rear lateral surface of the casing 2 in the horizontal mount configuration. The downstream lateral part 22 is a member configured to form the top lateral surface of the casing 2 in the vertical mount configuration and form the front lateral surface of the casing 2 in the horizontal mount configuration. The upstream lateral part 21 and the downstream lateral part 22 are disposed away from each other in the lengthwise direction of the casing 2 (i.e., a direction along the rotary axis A and the opening directions B, C and D). The upstream lateral part 21 has the intake port 11. The intake port 11 is an opening bored in the middle of the upstream lateral part 21 and is made in the form of a rectangular aperture. The downstream lateral part 22 has the blow-out port 12. The blow-out port 12 is an opening bored in the downstream lateral part 22 so as to be displaced from the middle of the downstream lateral part 22, and is made in the form of a rectangular aperture. The blow-out port 12 is herein located in a position close to the second lateral part 24 within the downstream lateral part 22. The first lateral part 23 is a member configured to form the front lateral surface of the casing 2 in the vertical mount configuration and form the right lateral surface of the casing 2 in the horizontal mount configuration. The second lateral part 24 is a member configured to form the rear lateral surface of the casing 2 in the vertical mount configuration and form the left lateral surface of the casing 2 in the horizontal mount configuration. The first lateral part 23 and the second lateral part 24 are disposed away from each other in a direction orthogonal to the lengthwise direction of the casing 2 (i.e., the horizontal direction X orthogonal to the rotary axis A and the opening directions B, C and D in the vertical mount configuration; a right-and-left direction Y orthogonal to the rotary axis A and the opening directions B, C and D in the horizontal mount configuration). The third lateral part 25 is a member configured to form the right lateral surface of the casing 2 in the vertical mount configuration and form the top lateral surface of the casing 2 in the horizontal mount configuration. The fourth lateral part 26 is a member configured to form the left lateral surface of the casing 2 in the vertical mount configuration and form the bottom lateral surface of the casing 2 in the horizontal mount configuration. The third lateral part 25 and the fourth lateral part 26 are disposed away from each other in a direction orthogonal to the lengthwise direction of the casing 2 (i.e., the right-and-left direction Y orthogonal to the rotary axis A and the opening directions B and C in the vertical mount configuration; the vertical direction Z orthogonal to the rotary axis A and the opening directions B, C and D in the horizontal mount configuration).

Moreover, a plurality of ridges 21*a* are herein formed on the upstream lateral part 21 so as to enclose the circumferential edges of the intake port 11, whereas a plurality of ridges 22*a* are formed on the downstream lateral part 22 so as to enclose the circumferential edges of the blow-out port 12. Furthermore, an intake duct 18 is connected to the intake port 11 through the ridges 21*a*, whereas a blow-out duct 19 is connected to the blow-out port 12 through the ridges 22*a*. With the construction, the air conditioning apparatus 1 is herein configured to be of a duct connection type fir sucking and blowing air from and to an air-conditioned room indirectly through the ducts 18 and 19. It should be herein noted that the intake port 11 and the blow-out port 12 are made in forms of rectangular apertures, and likewise, the ducts 18 and 19 are made in forms of rectangular tubes. However, the ports 11 and 12 and the ducts 18 and 19 are not limited to be made in the aforementioned forms, and may employ a variety of forms. Furthermore, the air conditioning apparatus 1 is not limited to be of the duct connection type, and may be of a variety of types such as a type for sucking and blowing air from and to an air-conditioned room directly through the intake port 11 and the blow-out port 12.

As described above, the partition member 3 divides the interior of the casing 2 into the heat exchanger compartment S1 located on the intake port 11 side and the fan compartment S2 located on the blow-out port 12 side, and has the fan entrance 13 that makes the heat exchanger compartment S1 and the fan compartment S2 communicate with each other. The partition member 3 is mainly composed of a partition body 31 made in the form of a rectangular plate. The partition body 31 is disposed in parallel to a direction orthogonal to the lengthwise direction of the casing 2 (i.e., a direction orthogonal to the rotary axis A and the opening directions B, C and D). The fan entrance 13 is bored in the partition body 31 and is herein made in the form of a circular aperture. The partition body 31 has a partition circumferential part 32 made in the form of a rectangular frame. The partition circumferential part 32 extends from the circumferential edges of the partition body 31 toward the fan compartment S2 along the inner surfaces of the lateral parts 23 to 26 of the casing 2.

As described above, the heat exchanger 4 is mounted in the heat exchanger compartment S1. In a cooling operation, the heat exchanger 4 is configured to cool air flowing through the heat exchanger compartment S1 by a refrigerant. Contrarily in a heating operation, the heat exchanger 4 is also capable of heating air flowing through the heat exchanger compartment S1 by the refrigerant. A fin tube heat exchanger, composed of multiple fins and a heat transfer tube, is herein employed as the heat exchanger 4. Furthermore, the refrigerant is configured to be supplied to the heat exchanger 4 from an outdoor unit installed outside the building or so forth. The heat exchanger 4 is composed of a part 41 located closely to the third lateral part 25 of the casing 2 and a part 42 located closely to the fourth lateral part 26 of the casing 2. Moreover, the part 41 of the heat exchanger 4, located closely to the third lateral part 25, is disposed in a tilt position so as to get closer to the third lateral part 25 from a side near to the fan entrance 13 to a side near to the intake port 11. The part 42 of the heat exchanger 4, located closely to the fourth lateral part 26, is disposed in a tilt position so as to get closer to the fourth lateral part 26 from the side near to the fan entrance 13 to the side near to the intake port 11. With the construction, the heat exchanger 4 has a V shape so as to get closer to the third lateral part 25 and the fourth lateral part 26 of the casing 2 from the side near to the fan entrance 13 to the side near to the intake port 11. It should be noted that the heat exchanger 4 is not limited to have the V shape, and may employ a variety of shapes.

Moreover, drain pans 43 and 44 are mounted in the heat exchanger compartment S1 in order to receive water produced by dew condensation in the heat exchanger 4. The first drain pan 43 is configured to be used when the casing 2 is disposed such that the rotary shaft 52 (the rotary axis A) of the bladed wheel 51 is oriented to the horizontal direction X (in the horizontal mount configuration). The second drain pan 44 is configured to be used when the casing 2 is disposed such that the rotary shaft 52 (the rotary axis A) of the bladed wheel 51 is oriented to the vertical direction Z (in the vertical mount configuration). The first drain pan 43 is disposed in a position close to the fourth lateral part 26, which is one of the lateral parts 23 to 26 of the casing 2 that are disposed along the opening direction B of the fan entrance 13. With the construction, the first drain pan 43 is configured to be disposed over the fourth lateral part 26 forming the bottom lateral surface of the casing 2 and receive the bottom side of the heat exchanger 4 in the horizontal mount configuration. The second drain pan 44 is disposed in a position close to the upstream lateral part 21, which is one of the lateral parts 21 and 22 of the casing 2 that are disposed along the direction orthogonal to the opening direction B of the fan entrance 13. With the construction, the second drain pan 44 is configured to be disposed over the upstream lateral part 21 forming the bottom lateral surface of the casing 2 and receive the bottom side of the heat exchanger 4 in the vertical mount configuration. Furthermore, the first and second drain pans 43 and 44 are herein compatible with the vertical mount configuration and the horizontal mount configuration, but the first drain pan 43 to be used in the horizontal mount configuration exists in the heat exchanger compartment S1 even in the vertical mount configuration, whereas the second drain pan 44 to be used in the vertical mount configuration exists in the heat exchanger compartment S1 even in the horizontal mount configuration.

As described above, the centrifugal fan 5 includes the bladed wheel 51 having the plural rearward blades 53 and is configured to suck air existing in the heat exchanger compartment S1 into the fan compartment S2 through the fan entrance 13, with the bladed wheel 51 being mounted in the fan compartment S2 such that the rotary shaft 52 (the rotary axis A) is oriented to the opening direction B of the fan entrance 13. Furthermore, a fan motor 59 is mounted in the fan compartment S2 in order to drive and rotate the bladed wheel 51. Here in the fan compartment 2, the bladed wheel 51 is disposed proximally to the fan entrance 13 and the fan motor 59 is disposed on the downwind side of the bladed wheel 51 along the rotary shaft 52 (the rotary axis A) of the bladed wheel 51. Moreover, a bell mouth 33 is mounted to the fan entrance 13. A space, located on the downwind side of the bladed wheel 51 in the fan compartment S2, is herein defined as a fan downwind space S21. Thus, the fan motor 59 is disposed in the fan downwind space S21.

The bladed wheel 51 is composed of a hub 54, a shroud 55 and the plural rearward blades 53 disposed between the hub 54 and the shroud 55. The hub 54 connects the blow-out port 12 side ends of the plural rearward blades 53, and is configured to be rotated about the rotary shaft 52 (the rotary axis A). The hub 54 is a disc-shaped member and has a hub protrusion 54*a* protruding from its middle toward the shroud 55. The hub protrusion 54*a* is coupled to the fan motor 59. The shroud 55 is disposed on the fan entrance 13 side of the hub 54 so as to be opposed to the hub 54, connects the fan entrance 13 side ends of the plural rearward blades 53, and is configured to be rotated about the rotary shaft 52 (the rotary axis A). The shroud 55 is an annular member and has a fan opening 55*a* that is bored in the form of a circular aperture and is centered at the rotary shaft 52 (the rotary axis A). The shroud 55 has a curved shape that its outer diameter increases toward a side near to the hub 54. The plural rearward blades 53 are disposed between the hub 54 and the shroud 55 so as to be aligned at predetermined intervals along the circumferential direction of the rotary shaft 52 (the rotary axis A). Each rearward blade 53 tilts oppositely to a rotary direction R of the bladed wheel 51 (herein a clockwise direction in a view seen from the blow-out port 12 side) with respect to the radial direction of the hub 54.

The bell mouth 33 is mounted to the fan entrance 13 of the partition member 3 so as to be opposed to the fan opening 55*a* of the bladed wheel 51 and directs air, flowing thereto from the heat exchanger compartment S1, to the fan opening 55*a* of the bladed wheel 51. The bell mouth 33 is an annular member centered at the rotary shaft 52 (the rotary axis A). The bell mouth 33 has a curved shape that its outer diameter decreases toward a side near to the shroud 55.

The fan motor 59 is disposed concentrically to the rotary shaft 52 (the rotary axis A) of the bladed wheel 51 in the fan downwind space S21. The fan motor 59 has a columnar shape centered at the rotary shaft 52 (the rotary axis A). The fan motor 59 is herein fixed to the partition member 3 through a motor support base 34. Specifically, the motor support base 34 is composed of support frames 35 and 36 forming a roughly squared U shape. The support frames 35 and 36 respectively extend toward the vicinity of the outer peripheral surface of the fan motor 59 from parts of the partition circumferential part 32 of the partition member 3, i.e., a part located closely to the third lateral part 25 of the casing 2 and a part located closely to the fourth lateral part 26 of the casing 2. Moreover, the fan motor 59 is fixed at its end plate parts 59*a* to the support frames 35 and 36 through a bracket 37. The end plate parts 59*a* extend from the outer peripheral surface of the fan motor 59 toward the third lateral part 25 and the fourth lateral part 26. Thus, the centrifugal fan 5, including the bladed wheel 51 and the fan motor 59, is designed to be fixed to the partition member 3 through the motor support base 34. With the construction, the entirely of the centrifugal fan 5 is configured to be detachable by detaching the partition member 3 from the casing 2 in performing a maintenance work or so forth.

Moreover, the fan downwind space S21 of the fan compartment S2 has a blow-out port opposed space S22 as a region opposed to the blow-out port 12. The blow-out port 12 is herein disposed in the position close to the second lateral part 24 within the downstream lateral part 22. Thus, when the casing 2 is seen from the blow-out port 12 side, the blow-out port opposed space S22 is formed by a space enclosed by parts located along the circumferential edges of the opening of the blow-out port 12, i.e., the second lateral part 24, a part of the third lateral part 25 that is located closely to the second lateral part 24, and a part of the fourth lateral part 26 that is located closely to the second lateral part 24. Furthermore, a blow-out port non-opposed surface part 27 is mounted in a position on the downwind side of the bladed wheel 51 so as to be opposed to the fan entrance 13, and accordingly, a blow-out port non-opposed space S23 is formed as a space excluding the blow-out port opposed space S22 within the fan downwind space S21 so as not to be opposed to the blow-out port 12 but to be opposed to the blow-out port non-opposed surface part 27. Moreover, a blow-out port circumferential surface part 28 is herein provided so as to extend from the blow-out port 12 side end of the blow-out port non-opposed surface part 27 toward the blow-out port 12 along the opening direction B of the fan entrance 13 and the opening direction C of the blow-out port 12. With the construction, an electric component compartment S3 is herein formed by the blow-out port non-opposed surface part 27, the blow-out port circumferential surface part 28, the first lateral part 23, the third lateral part 25, the fourth lateral part 26, and a part of the downstream lateral part 22 that is located closely to the first lateral part 23 and in which the blow-out port 12 is not formed. The electric component compartment S3 accommodates electric components 14 to be used for controlling devices that make up the air conditioning apparatus 1. Furthermore, a blow-out pathway region S24, having the same opening size as the blow-out port 12, is formed by a region located closely to the blow-out port 12 within the blow-out port opposed space S22, i.e., a space enclosed by the blow-out port circumferential surface part 28, the second lateral part 24, a part of the third lateral part 25 that is located closely to the second lateral part 24, and a part of the fourth lateral part 26 that is located closely to the second lateral part 24.

Moreover, an electric heater 6 is herein mounted in the fan downwind space S21 of the fan compartment S2 in order to heat air blown out to the fan downwind space S21 by the bladed wheel 51 of the centrifugal fan 5. The electric heater 6 is heating means for heating air flowing through the fan compartment S2 in a heating operation. A heating element assembly with coiled electric heating wires is herein employed as the electric heater 6 (heating means). The electric heater 6 (the heating means) is disposed in the blow-out port opposed space S22, i.e., a region opposed to the blow-out port 12 within the fan downwind space S21. More specifically, the electric heater 6 (the heating means) is disposed in the blow-out pathway region S24 close to the blow-out port 12 within the blow-out port opposed space S22. It should be noted that the electric heater 6 (the heating means) is not limited to the heating element assembly with the coiled electric heating wires, and alternatively, may employ a variety of types of heater.

(2) Basic Action of Air Conditioning Apparatus

Next, a basic action of the air conditioning apparatus 1 will be explained with FIGS. 1 to 8.

In the air conditioning apparatus 1 having the aforementioned construction, the bladed wheel 51 of the centrifugal fan 5 is configured to be rotated by driving of the fan motor 59. This produces the flow of air passing through the interior of the casing 2 sequentially in the order of the intake port 11, the heat exchanger compartment S1, the fan entrance 13, the fan compartment S2 and the blow-out port 12.

Now in the cooling operation, air fed to the interior of the casing 2 through the intake port 11 flows into the heat exchanger compartment S1, and is cooled by the refrigerant flowing through the heat exchanger 4. Then, the air cooled by the heat exchanger 4 flows into the fan compartment S2 through the fan entrance 13 and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is fed to the outside of the casing 2 through the blow-out port 12.

On the other hand, in the heating operation, air fed to the interior of the casing 2 through the intake port 11 flows into the heat exchanger compartment S1, and is heated by the refrigerant flowing through the heat exchanger 4. The air heated by the heat exchanger 4 flows into the fan compartment S2 through the fan entrance 13, and is sucked into the bladed wheel 51 of the centrifugal fan 5. The air sucked into the bladed wheel 51 is blown out to the fan downwind space S21 located on the downwind side of the bladed wheel 51. The air blown out to the fan downwind space S21 is further heated by the electric heater 6 (the heating means), and is then fed to the outside of the casing 2 through the blow-out port 12.

(3) Construction for Enabling Bladed Wheel made of Resin to be Employed as Bladed Wheel for Centrifugal Fan It can be assumed to employ a bladed wheel made of resin as the bladed wheel 51 of the centrifugal fan 5 in the air conditioning apparatus 1 having the aforementioned basic construction for the purposes of reduction in weight and enhancement in performance.

The air conditioning apparatus 1 herein has the following construction: the centrifugal fan 5 having the rearward blades 53 is mounted in the fan compartment S2 having the fan entrance 13 bored in opposition to the blow-out port 12 such that the rotary shaft 52. (the rotary axis A) is oriented to the opening direction B of the fan entrance 13 and the opening direction C of the blow-out port 12; and the electric heater 6 (the heating means) is mounted in the vicinity of the blow-out port 12.

Because of the construction, when a bladed wheel made of resin is employed as the bladed wheel 51 of the centrifugal fan 5 in the air conditioning apparatus 1, chances are that when an event occurs that an operation of the centrifugal fan 5 stops due to a trouble of the fan motor 59 or so forth while an operation of the electric heater 6 (the heating means) continues, the bladed wheel 51 of the centrifugal fan 5 is heated by radiant heat from the electric heater 6 (the heating means) and is damaged or broken.

Therefore, the air conditioning apparatus 1 is required to enable a bladed wheel made of resin to be employed as the bladed wheel 51 of the centrifugal fan 5 when the electric heater 6 (the heating means) is mounted in the vicinity of the blow-out port 12.

In view of the above, a construction for shielding radiant heat from the electric heater 6 (the heating means) is herein contrived. Specifically, a fan heat shield member 38 is mounted in the fan downwind space S21 in order to cover a part of the bladed wheel 51 that is opposed to the electric heater 6 (the heating means) (see FIGS. 9 to 12). The fan heat shield member 38 is herein a disc-shaped member centered at the rotary shaft 52 (the rotary axis A) of the bladed wheel 51, and is mounted so as to cover a part of the bladed wheel 51 that is located in the blow-out port non-opposed space S23 as well as the aforementioned part of the bladed wheel 51 that is opposed to the electric heater 6 (the heating means) (herein, a part located in the blow-out port opposed space S22). Furthermore, the fan heat shield member 38 is herein disposed between the fan motor 59 and the hub 54 of the bladed wheel and is supported together with the fan motor 59 by the motor support base 34. Moreover, the fan heat shield member 38 has an aperture in the middle part thereof, and the rotary shaft 52 penetrates therethrough.

It should be herein noted that the fan heat shield member 38 is a disc-shaped member and covers the entirety of the downwind side part of the bladed wheel 51. However, the construction of the fan heat shield member 38 is not limited to the above. For example, the fan heat shield member 38 may be a semicircular member for covering only the part of the bladed wheel 51 that is opposed to the electric heater 6 (the heating means) (i.e., only the part located in the blow-out port opposed space S22).

Thus, the electric heater 6 (the heating means) is herein designed to be mounted in the blow-out port opposed space S22, and the fan heat shield member 38 is designed to be mounted in the fan downwind space S21 so as to cover the part of the resin-made bladed wheel 51 that is opposed to the electric heater 6 (the heating means). With the construction, even when an event herein occurs that an operation of the centrifugal fan 5 stops while an operation of the electric heater 6 (the heating means) continues, it is possible to prevent damage or breakage of the resin-made bladed wheel 51 by radiant heat from the electric heater 6 (the heating means).

Consequently, when the electric heater 6 (the heating means) is herein mounted in the vicinity of the blow-out port 12, a bladed wheel made of resin can be employed as the bladed wheel 51 of the centrifugal fan 5.

Moreover, the fan heat shield member 38 herein has a size smaller than or equal to an outer diameter φ1 of the bladed wheel 51 (see FIG. 10), when seen from a direction along the rotary shaft 52 (the rotary axis A). When a disc-shaped fan heat shield member is herein employed as the fan heat shield member 38, its outer diameter φ2 is set to be less than or equal to the outer diameter φ1 of the bladed wheel 51. Furthermore, the outer diameter φ2 of the fan heat shield member 38 is set to be equal to the outer diameter φ1 of the hub 54 of the bladed wheel 51 so as not to degrade heat shielding performance. Additionally, the fan heat shield member 38 herein covers a part of the hub 54 that is opposed to the electric heater 6 (the heating means).

Thus, when herein disposed in the fan downwind space S21, the fan heat shield member 38 is set to have a size of less than or equal to the outer diameter φ1 of the bladed wheel 51 in a view seen from the direction along the rotary shaft 52 (the rotary axis A). With the construction, the fan heat shield member 38 can be herein disposed in the fan downwind space S21 without increasing ventilation resistance as much as possible.

Consequently, degradation in ventilation performance of the centrifugal fan 5 can be herein inhibited as much as possible, and simultaneously, the fan heat shield member 38 can be disposed in the fan downwind space S21. Furthermore, it is herein possible to prevent damage or breakage of the hub 54 disposed closest to the electric heater 6 (the heating means) among the constituent elements of the bladed wheel 51 of the centrifugal fan 5.

Figure 11:
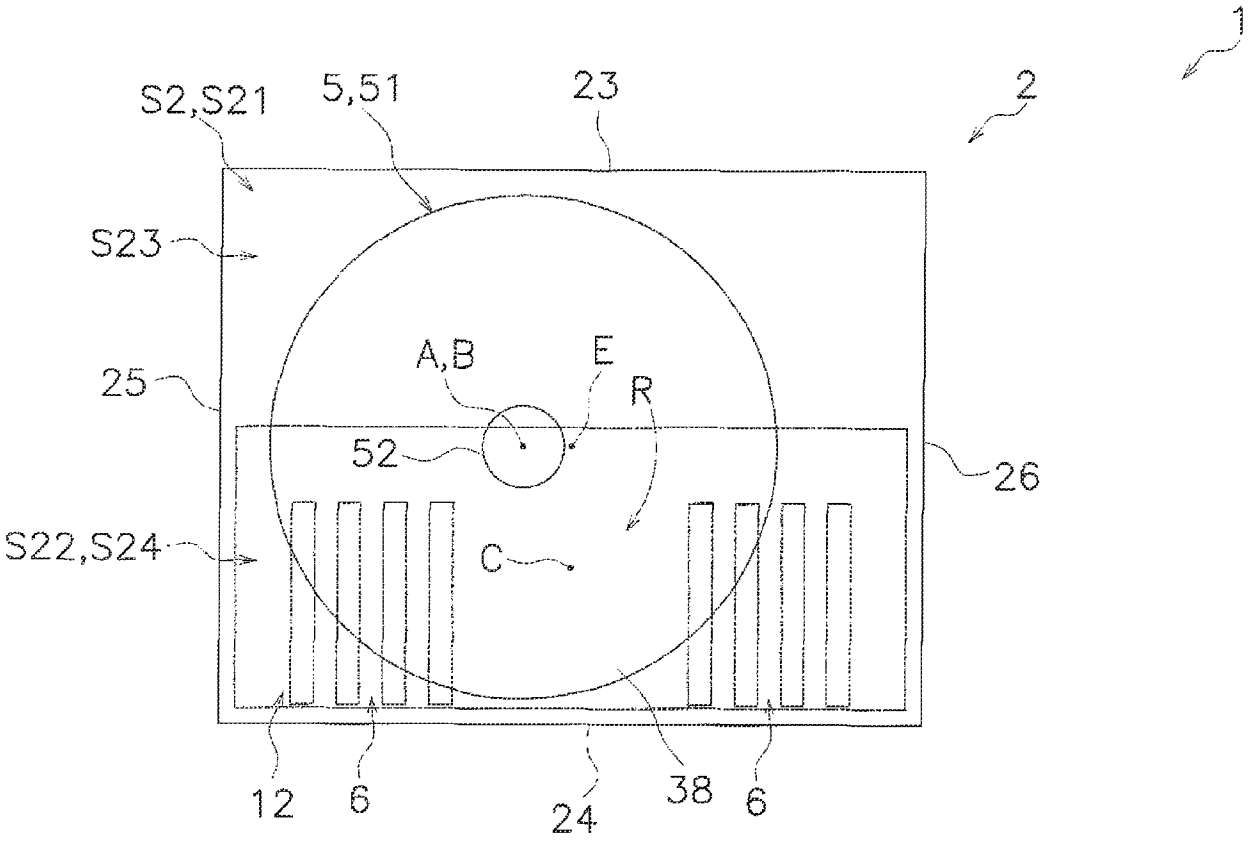
FIG. 11 is a cross-sectional view of FIG. 9 taken along line I-I.
Figure 13:
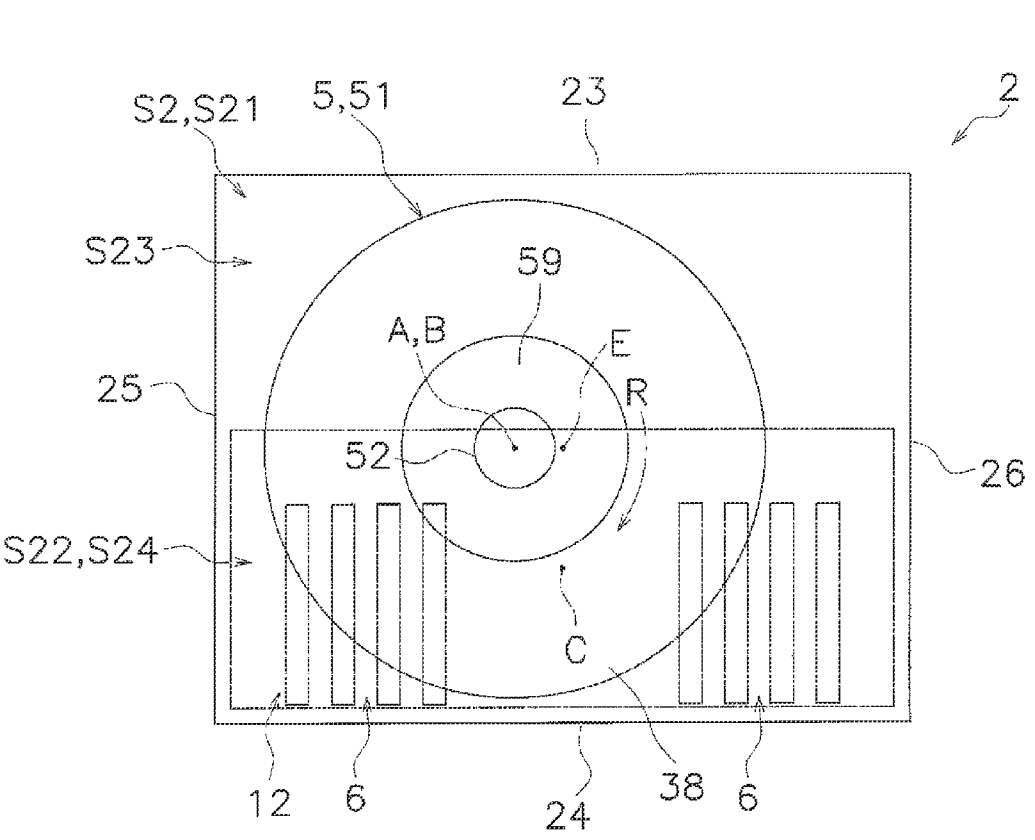
FIG. 13 is a diagram corresponding to FIG. 11 and shows a construction that a part of a fan heat shield member, overlapping with a fan motor, is cut out.

Moreover, a part of the fan heat shield member 38, overlapping with the fan motor 59, may be herein at least partially cut out when seen from the direction along the rotary shaft 52 (the rotary axis A) (see FIG. 13). Put differently, the fan heat shield member 38 may have not only such a hole that the rotary shaft 52 penetrates therethrough as shown in FIG. 11, but also a part of the fan heat shield member 38 that is opposed to the fan motor 59 and is entirely or partially cut out in consideration of positional arrangement of the fan motor 59 disposed between the fan heat shield member 38 and the electric heater 6 (the heating means).

Thus, when the fan heat shield member 38 and the fan motor 59 are herein disposed in the fan downwind space S21, the fan heat shield member 38 is designed to be disposed between the fan motor 59 and the hub 54 of the bladed wheel 51, and is designed to be at least partially cut out at a part thereof overlapping with the fan motor 59 when seen from the direction along the rotary shaft 52 (the rotary axis A). With the construction, the part of the fan heat shield member 38, covering the hub 54 of the bladed wheel 51, can be herein reduced in area.

Consequently, the fan heat shield member 38 can be herein reduced in size, and simultaneously, it is possible to prevent damage or breakage of the hub 54 of the bladed wheel 51 by radiant heat of the electric heater 6 (the heating means).

Figure 9:
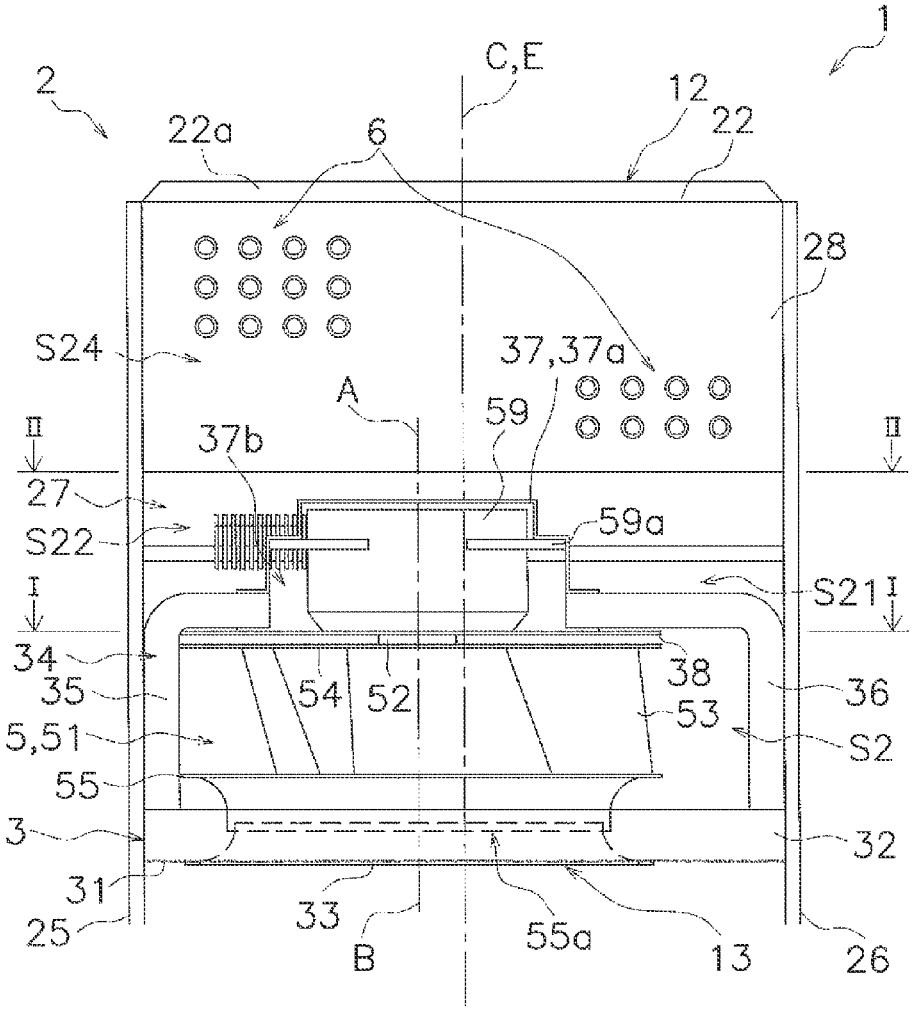
FIG. 9 is an enlarged view of a fan compartment and its vicinity in FIG. 3.
Figure 10:
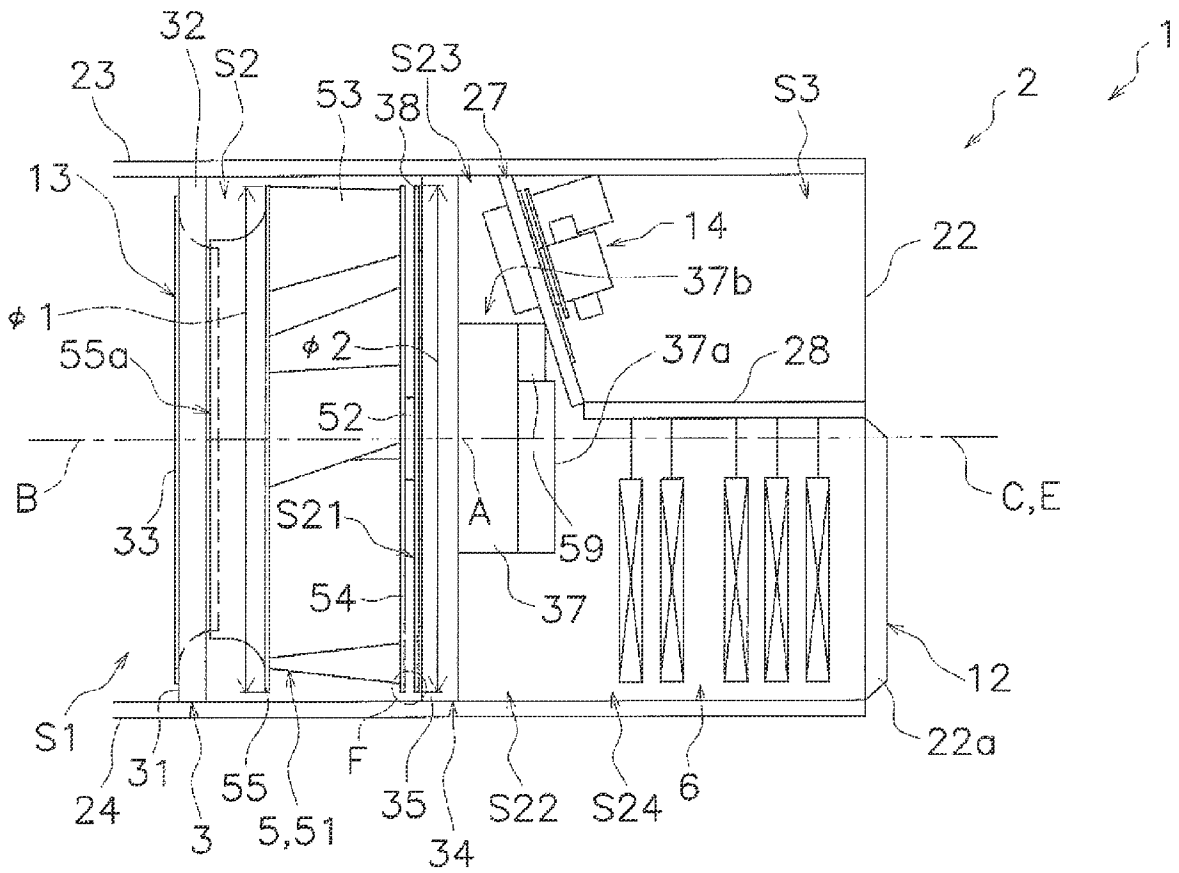
FIG. 10 is an enlarged view of the fan compartment and its vicinity in FIG. 4.
Figure 12:
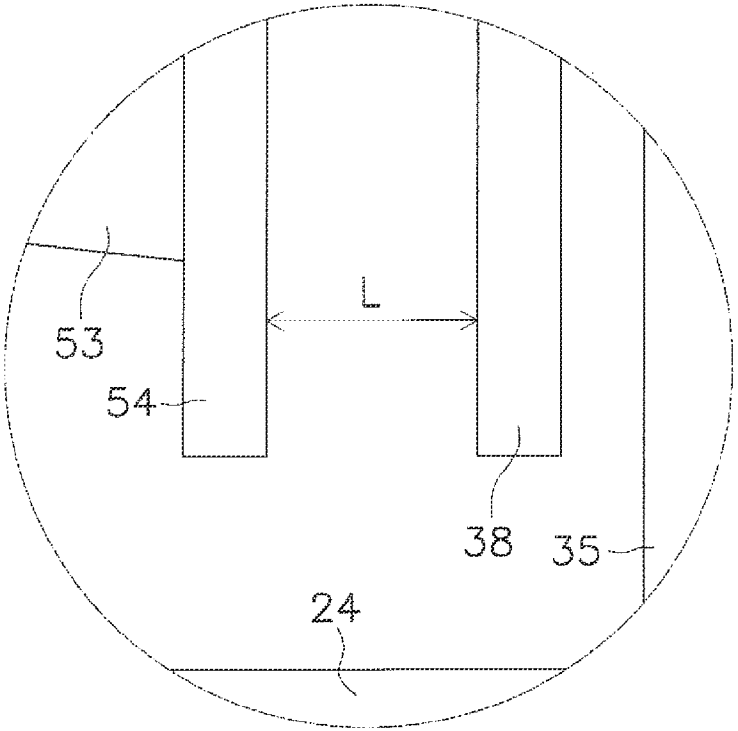
FIG. 12 is an enlarged view of a region F in FIG. 4.

Moreover, the fan heat shield member 38 is herein disposed away from the hub 54 through a gap L (see FIGS. 9, 10 and 12). Put differently, the fan heat shield member 38 is disposed on the downwind side of the hub 54 through the gap L. Specifically, the gap L between the fan heat shield member 38 and the hub 54 is herein set to have a dimension of 80 mm or less.

Thus, when herein disposed in the fan downwind space S21, the fan heat shield member 38 is designed to be disposed away from the hub 54 through the gap L. With the construction, it can be herein made difficult to transfer radiant heat from the electric heater 6 (the heating means) to the hub 54 through the fan heat shield member 38. Additionally, the gap L between the fan heat shield member 38 and the hub 54 is herein set to have a dimension of 80 mm or less. With the construction, the fan heat shield member 38 can be herein disposed in the fan downwind space S21 without increasing ventilation resistance as much as possible.

Consequently, it is herein possible to reliably prevent damage or breakage of the hub 54 disposed closest to the electric heater 6 (the heating means) among the constituent elements of the bladed wheel 51 of the centrifugal fan 5. Additionally, degradation in ventilation performance of the centrifugal fan 5 can be inhibited as much as possible.

Figure 14:
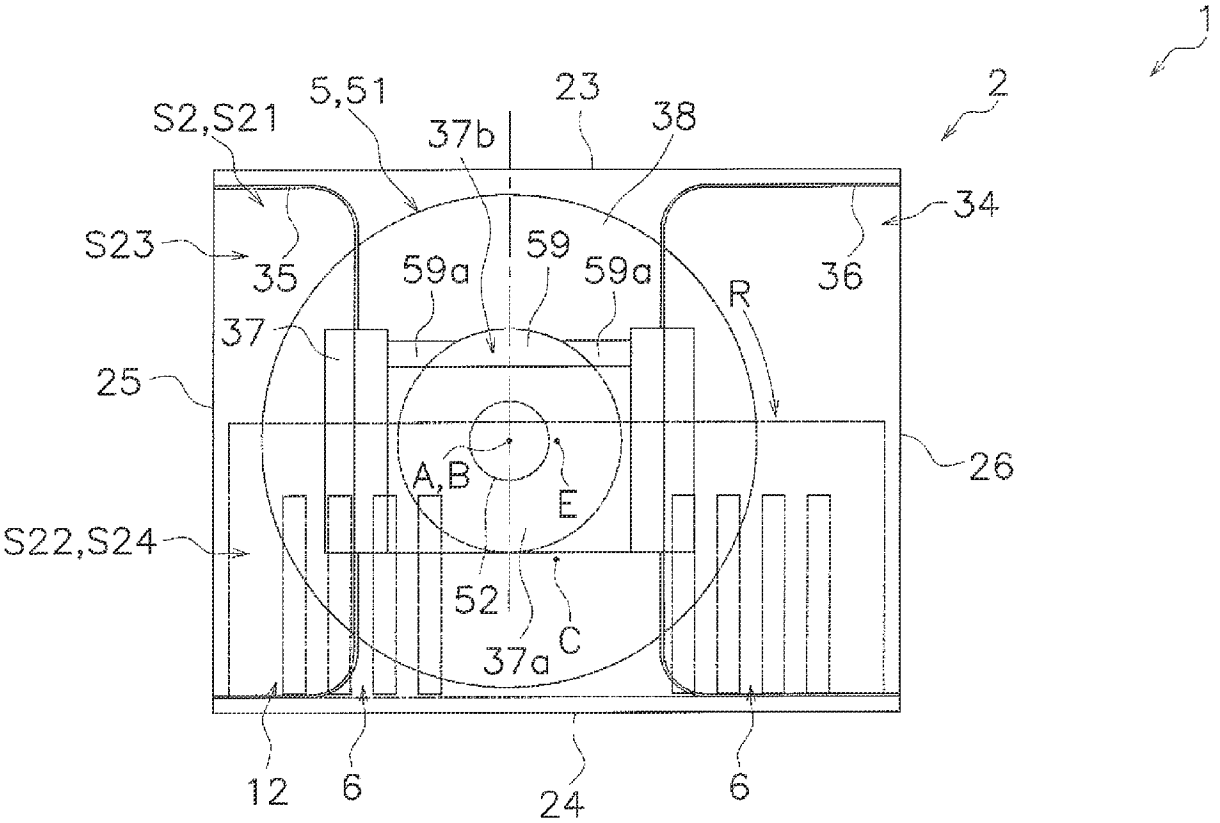
FIG. 14 is a cross-sectional view of FIG. 9 taken along line II-II.

Moreover, a motor heat shield part 37*a* (a motor heat shield member) is herein further provided for covering a part of the fan motor 59 that is opposed to the electric heater 6 (the heating means) (see FIGS. 9, 10 and 14). The bracket 37, which is one of the constituent members of the motor support base 34 for supporting the fan motor 59, partially makes up the motor heat shield part 37*a* (the motor heat shield member). Put differently, the part of the bracket 37, covering the fan motor 59, makes up the motor heat shield part 37*a* (the motor heat shield member).

Thus, when the fan motor 59 is herein disposed in the fan downwind space S21, the motor heat shield part 37*a* (the motor heat shield member) is designed to be further provided. With the construction, it is possible to prevent heating of the fan motor 59 by radiant heat from the electric heater 6 (heating means).

Consequently, it is herein possible to prevent abnormal overheating of the fan motor 59 by radiant heat from the electric heater 6 (the heating means).

Additionally, the motor heat shield part 37*a* (the motor heat shield member) herein has a motor guide port 37*b* for directing a part of air blown out to the fan downwind space S21 by the bladed wheel 51 to the blow-out port opposed space S22 through the fan motor 59 from the blow-out port non-opposed space S23 that is a region not opposed to the blow-out port 112 within the fan downwind space S21 (see FIGS. 9, 10 and 14). The motor heat shield part 37*a* (the motor heat shield member) is herein shaped so as not to cover a first lateral part 23 side part of the fan motor 59 (i.e., a part far from the blow-out port 12) and a second lateral part 24 side part of the fan motor 59 (i.e., a part near to the blow-out port 12). Hence, the motor heat shield part 37*a* (the motor heat shield member) has the motor guide port 37*b* made in the form of an opening that enables air to flow from the first lateral part 23 side to the second lateral part 24 side.

Thus, when the motor heat shield part 37*a* (the motor heat shield member) is herein disposed in the fan downwind space S21, the motor guide port 37*b* is designed to be formed. With the construction, it is herein possible to reliably cause air to flow in the vicinity of the fan motor 59.

Consequently, the fan motor 59 can be herein cooled by air blown out by the bladed wheel 51 of the centrifugal fan 5, and simultaneously, the motor heat shield part 37*a* (the motor heat shield member) can be disposed in the fan downwind space S21.

The invention claimed is:

1. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a plurality of rearward blades and being configured to suck air existing in the heat exchanger compartment into the fan compartment through the fan entrance, with the bladed wheel being mounted in the fan compartment such that a rotary shaft of the bladed wheel is oriented along a first axial direction perpendicular to a second lateral direction along which the partition member extends, and the bladed wheel being made of resin;

a heater mounted in a blow-out port opposed space, the blow-out port opposed space being a region opposed to the blow-out port, the heater being located within a fan downwind space on a downwind side of the bladed wheel in the first axial direction along which the rotary shaft of the bladed wheel is oriented within the fan compartment; and a fan heat shield member mounted in the fan downwind space in order to cover a part of the bladed wheel that is opposed to the heater.

2. The air conditioning apparatus according to claim 1, wherein the fan heat shield member has a size no larger than an outer diameter of the bladed wheel when seen from a direction along the rotary shaft.

3. The air conditioning apparatus according to claim 2, wherein the bladed wheel has a hub, the hub connecting blow-out port side ends of the rearward blades and being configured to be rotated about the rotary shaft, and the fan heat shield member at least partially covers a part of the hub that is opposed to the heater.

4. The air conditioning apparatus according to claim 1, wherein the bladed wheel has a hub, the hub connecting blow-out port side ends of the rearward blades and being configured to be rotated about the rotary shaft, and the fan heat shield member at least partially covers a part of the hub that is opposed to the heater.

5. The air conditioning apparatus according to claim 4, wherein the fan heat shield member is spaced from the hub with a gap disposed therebetween.

6. The air conditioning apparatus according to claim 5, wherein the gap between the fan heat shield member and the hub is set to have a dimension of no more than 80 mm.

7. The air conditioning apparatus according to claim 6, further comprising:

a fan motor coupled to the hub and being mounted in the fan downwind space, the fan heat shield member being disposed between the hub and the fan motor, and the fan heat shield member being at least partially cut out at a part thereof overlapping with the fan motor when seen from the direction along the rotary shaft.

8. The air conditioning apparatus according to claim 5, further comprising:

a fan motor coupled to the hub and being mounted in the fan downwind space, the fan heat shield member being disposed between the hub and the fan motor, and the fan heat shield member being at least partially cut out at a part thereof overlapping with the fan motor when seen from the direction along the rotary shaft.

9. The air conditioning apparatus according to claim 4, further comprising:

a fan motor coupled to the hub and being mounted in the fan downwind space, the fan heat shield member being disposed between the hub and the fan motor, and the fan heat shield member being at least partially cut out at a part thereof overlapping with the fan motor when seen from the direction along the rotary shaft.

10. The air conditioning apparatus according to claim 9, further comprising:

a motor heat shield member covering a part of the fan motor that is opposed to the heater.

11. An air conditioning apparatus, comprising:

a casing having an intake port and a blow-out port;

a partition member dividing an interior of the casing into a heat exchanger compartment located on an intake port side and a fan compartment located on a blow-out port side, the partition member having a fan entrance, the fan entrance being bored in opposition to the blow-out port and making the heat exchanger compartment and the fan compartment communicate with each other;

a heat exchanger mounted in the heat exchanger compartment;

a centrifugal fan including a bladed wheel having a hub and a plurality of rearward blades, and being configured to suck air existing in the heat exchanger compartment into the fan compartment through the fan entrance, with the bladed wheel being mounted in the fan compartment such that a rotary shaft of the bladed wheel is oriented along an opening direction of the fan entrance and an opening direction of the blow-out port, and the bladed wheel being made of resin;

a heater mounted in a blow-out port opposed space, the blow-out port opposed space being a region opposed to the blow-out port within a fan downwind space, the fan downwind space being a space located on a downwind side of the bladed wheel within the fan compartment;

a fan heat shield member mounted in the fan downwind space in order to cover a part of the bladed wheel that is opposed to the heater;

a fan motor coupled to the hub and being mounted in the fan downwind space; and a motor heat shield member covering a part of the fan motor that is opposed to the heater, the hub connecting blow-out port side ends of the rearward blades and being configured to be rotated about the rotary shaft, the fan heat shield member at least partially covering a part of the hub that is opposed to the heater, the fan heat shield member being disposed between the hub and the fan motor, the fan heat shield member being at least partially cut out at a part thereof overlapping with the fan motor when seen from the direction along the rotary shaft, and the motor heat shield member having a motor guide port arranged and configured to direct a part of air blown out to the fan downwind space by the bladed wheel to the blow-out port opposed space through the fan motor from a blow-out port non-opposed space that is a region not opposed to the blow-out port within the fan downwind space.

* * * * *